US009920536B2

(12) United States Patent
Marhevka, Jr.

(10) Patent No.: US 9,920,536 B2
(45) Date of Patent: Mar. 20, 2018

(54) STAIR TREAD OVERLAY AND METHOD OF MANUFACTURING THE SAME

(71) Applicant: Penn Wood Products, Inc., East Berlin, PA (US)

(72) Inventor: Michael Andrew Marhevka, Jr., Carlisle, PA (US)

(73) Assignee: PENN WOOD PRODUCTS, INC., East Berlin, PA (US)

( * ) Notice: Subject to any disclaimer, the term of this patent is extended or adjusted under 35 U.S.C. 154(b) by 98 days.

(21) Appl. No.: 14/329,046

(22) Filed: Jul. 11, 2014

(65) Prior Publication Data

US 2016/0010339 A1 Jan. 14, 2016

(51) Int. Cl.
*E04F 11/17* (2006.01)

(52) U.S. Cl.
CPC ..... *E04F 11/175* (2013.01); *E04F 11/17* (2013.01)

(58) Field of Classification Search
CPC ..... E04F 11/166; E04F 11/175; E04F 19/061
USPC ..... 52/179, 182, 188
See application file for complete search history.

(56) References Cited

U.S. PATENT DOCUMENTS 606,532 A 6/1898 Furness
844,408 A 2/1907 Schachner
844,409 A 2/1907 Schachner
2,696,027 A 12/1954 Ryland
5,787,674 A 8/1998 Nelson
6,067,758 A 5/2000 Zenkner
6,115,975 A * 9/2000 Abdollahi ..... E04F 11/163 52/179
6,173,540 B1 1/2001 Spivey
6,960,273 B2 * 11/2005 Jung ..... E04F 11/175 156/324.4
8,141,321 B2 * 3/2012 Young ..... E04F 11/108 52/188
8,181,321 B2 * 5/2012 Tullmann ..... B23Q 1/44 269/58
D661,816 S * 6/2012 Young ..... D25/69
8,327,595 B2 * 12/2012 Stanchfield ..... E04F 15/02005 52/100
8,371,090 B2 2/2013 Young
8,505,250 B2 * 8/2013 Vanhastel ..... E04F 11/175 52/179
8,516,771 B2 * 8/2013 Mang, Sr. ..... E04F 11/09 52/182
2008/0271390 A1 11/2008 Lopez
2011/0179729 A1 * 7/2011 Thompson ..... E04F 11/104 52/179

* cited by examiner

*Primary Examiner* — Brian E Glessner
*Assistant Examiner* — Adam G Barlow
(74) *Attorney, Agent, or Firm* — Buchanan Ingersoll & Rooney PC

(57) ABSTRACT

A stair tread overlay for a staircase includes a generally planar stair tread having an upper surface, a bottom surface, and a rounded nosing extending from an end surface thereof; and a scotia element joined to the stair tread, the scotia element including a front contoured surface and a planar back side surface, wherein the bottom surface of the stair tread includes one of a tongue or groove and an upper surface of the scotia element includes the other of a tongue or groove and the tongue and groove of the tread and the scotia element are secured together to form a joint to thereby connect the scotia element to the tread.

3 Claims, 3 Drawing Sheets

STAIR TREAD OVERLAY AND METHOD OF MANUFACTURING THE SAME

TECHNICAL FIELD

The disclosure herein is directed to a stair tread overlay, and more particularly to a stair tread overlay having a scotia element attached to a bottom front edge of the tread.

BACKGROUND

A majority of residential housing units built in the U.S. from the 1960's through the late 1990's utilized wall-to-wall carpeting as an aesthetically pleasing and relatively inexpensive alternative to labor intensive and messy hardwood flooring installation. With the introduction of new hardwood flooring systems including the beautiful and trouble free installation of pre-finished styles, homeowners find many more design choices to consider as they remodel. As the carpeting is removed to accommodate installation of new flooring, however, homeowners quickly find that their staircases may have been constructed using plywood, and will require extensive renovation.

Removing the existing staircase and replacing it with hardwood steps to match the new flooring choice is an expensive and time consuming proposition. Hence, it is more economical to cover the existing stairs in much the same way that the existing floor is covered with the new pre-finished flooring product.

However, current construction methods for overlay stair treads yield an appearance which is deficient in aesthetic appeal and inefficient in the use of raw materials. An overlay stair tread on which the bull nose and scotia element (or cove molding) are attached vertically with relation to the horizontal surface of the tread yields a differentiation in grain direction between the two pieces, and yields a "striped" appearance after staining and finishing. This is shown, for example, in U.S. Pat. Nos. 8,141,321 and 8,371,090.

Further, because of mandated dimensional requirements on Building Codes, vertically attached bull nose elements must be manufactured from expensive and in some cases rare or non-existent 5-4 raw material as opposed to the 4-4 stock which can be used for the stair tread overlay.

Accordingly, there exists a need in the marketplace for an improved stair tread overlay and a method of manufacturing the same.

SUMMARY

The disclosure here is directed to a stair tread overlay for a staircase, comprising a generally planar stair tread having an upper surface, a bottom surface, and a rounded nosing extending from an end surface thereof; and a scotia element joined to said stair tread, said scotia element including a front contoured surface and a planar back side surface. The bottom surface of said stair tread includes one of a tongue or groove and an upper surface of said scotia element includes the other of a tongue or groove such that said tongue and groove of said tread and said scotia element are secured together to form a joint to thereby connect said scotia element to said tread.

A further aspect of the disclosure provides a method of making a stair tread overlay, comprising the steps of providing a generally planar stair tread having an upper surface and a bottom surface; providing a scotia element having an upper surface and a contoured front surface; forming one of a tongue or groove in the bottom surface of the stair; forming the other of a tongue or groove in the upper surface of the scotia element; mating the tongue and the groove and thereby securing the scotia element to the bottom surface of the stair tread with adhesive, and machining the tread after the steps of mating the tongue and groove and securing the tongue and groove with adhesive.

BRIEF DESCRIPTION OF THE DRAWING FIGURES

These and other features and advantages of the disclosure herein are described in the following detailed description, in conjunction with the appended drawings in which.

DETAILED DESCRIPTION

Figure 1:
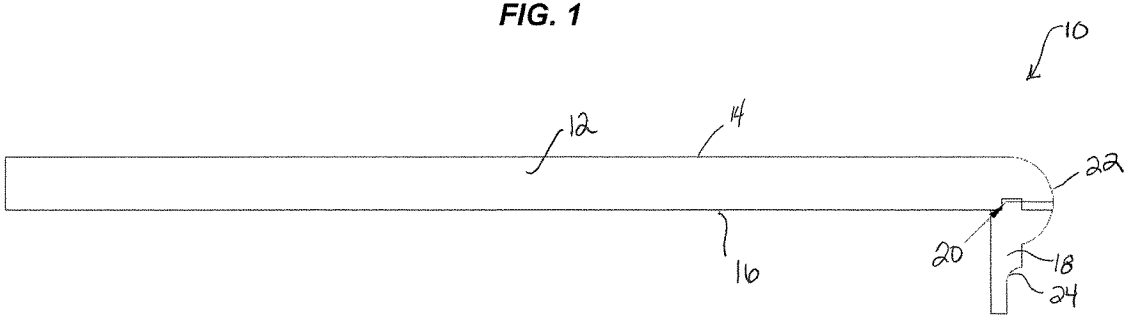
FIG. 1 is side view of a stair tread overlay in accordance with an exemplary embodiment disclosed herein.
Figure 2:
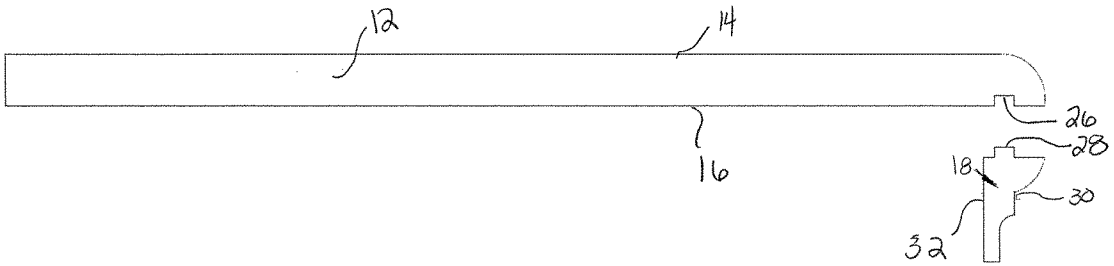
FIG. 2 is a side view of the stair tread overlay shown in FIG. 1, in an exploded condition.
Figure 3:
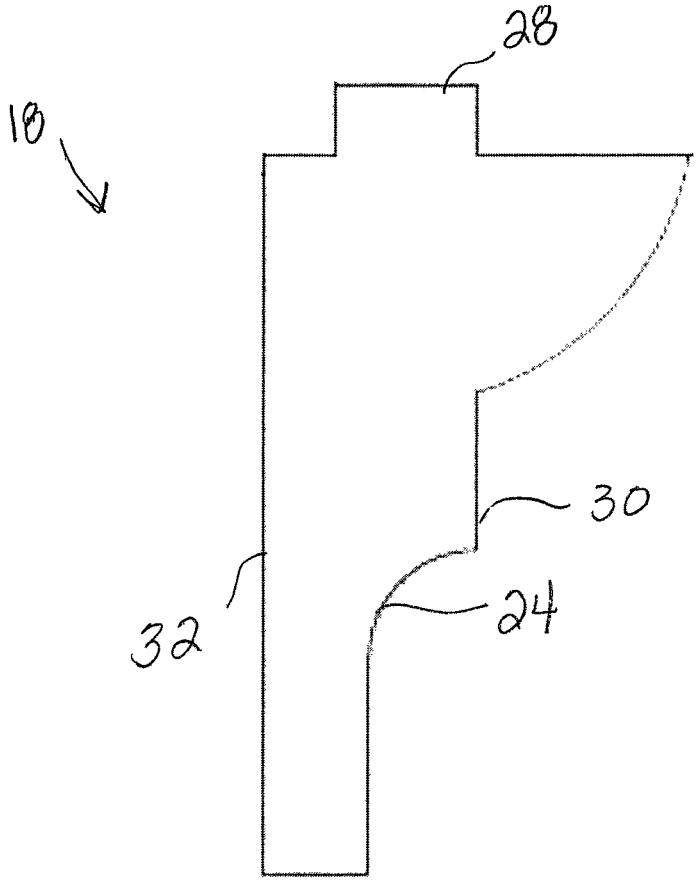
FIG. 3 is an enlarged view of the scotia element shown in FIG. 1.
Figure 4:
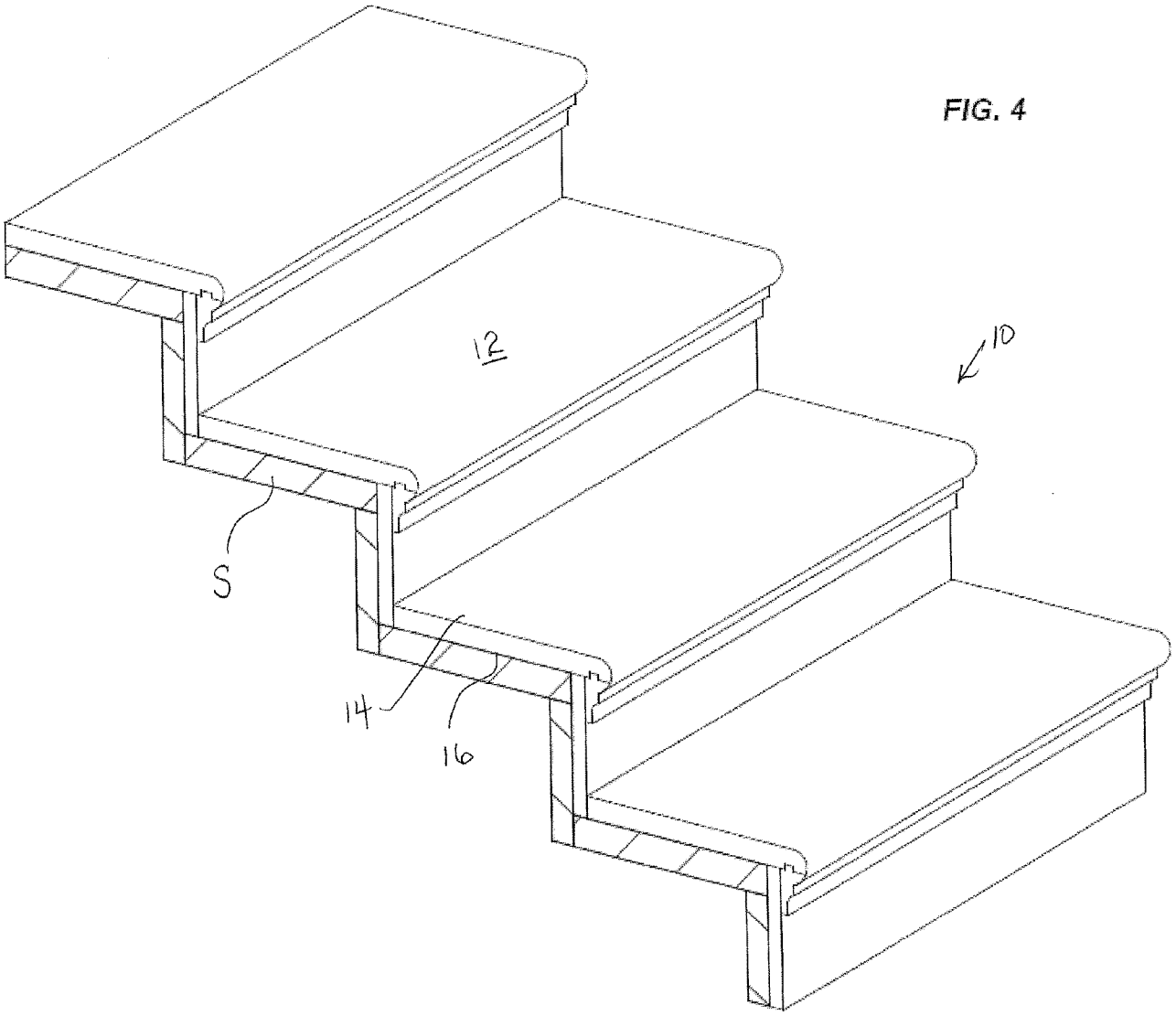
FIG. 4 is a side view of a plurality of stair tread overlays shown in FIG. 1, as installed over an existing staircase.

A stair tread overlay may be employed for the purpose of aesthetically or functionally improving an existing step surface. A stair tread overlay in accordance with an exemplary embodiment of the disclosure herein is shown generally by reference numeral 10 in FIGS. 1-4. Stair tread overlay 10 includes a horizontal, flat step surface 12 coinciding with the width and length dimensions of the existing stair step and a decorative and functional scotia 18 attached to the bottom front edge of the step surface 12 by a tongue and groove joint 20. As shown, stair tread overlay 10 comprises a stair step surface 12, commonly referred to as a tread surface, having an upper surface 14 exposed during installation which acts as the step surface, and a bottom surface 16 which accepts the attachment of the scotia 18. The scotia 18 in its finished position completes the arc of a bull nose 22 and adds, as a single piece, the functional and decorative cove moulding 24 which is observed as an appealing design element for the front of the tread 10. The scotia 18 thus defines a front contoured surface 30 and a planar back side surface 32 which is disposed adjacent a riser (not shown) of the staircase. As shown best in FIG. 4, a plurality of stair tread overlays 10 can be installed over an existing staircase S.

To facilitate the production of the stair tread overlay 10, a tongue and groove configuration 20 is preferably employed to facilitate the positive location of the scotia 18 to the bottom 16 of the tread 12.

The bottom 16 of the stair tread 12 is preferably precision machined with a groove 26 which runs along its length at a prescribed width and depth and distance from the lower front edge. Alternatively, however, one skilled in the art will recognize that a tongue could be formed on the bottom 16 of the stair tread 12.

The scotia 18 is moulded in a continuous piece of precise and repeatable dimensions, and includes a tongue 28 configured to match the groove 26 in the bottom 16 of the stair tread 12. Alternatively, however, one skilled in the art will recognize that a groove could be formed in the upper surface of scotia 18 that is configured to receive a tongue formed on the bottom surface of the stair tread.

The scotia 18 is attached to the bottom 16 of the stair tread 12 in an efficient and productive manner, preferably by gluing, although other manners of attachment could also be used, such as driving a brad through scotia 18 into the bottom side of stair tread 12. During the gluing operation the scotia 18 and stair tread 12 are mated after a coat of adhesive is applied to the groove 26, and the resultant assembled construction is disposed in a press which squeezes the elements together until the adhesive is totally cured.

The tongue and groove joint 20 adds to the efficiency of the final construction in that, during the assembly step, it ensures the positive placement of the scotia 18 and stair tread 12 in relation to each other, which is important for manufacturing efficiency. Further, the positive placement of the scotia 18 and stair tread 12 increases the aesthetic appeal by helping to eliminate gaps and joint failure. In addition, the increase in glue surface area presented by the tongue and groove joint 20 improves adhesion and mechanical strength of the bond which will decrease joint failure during stair tread use. A single lumber supply can also be used for all stair tread overlay components, thus eliminating the requirement of an expensive dual thickness product.

The attachment of the scotia element 18 to the bottom 16 of the stair tread 12 improves appearance by allowing the upper surface 14 of the stair tread 12 to be manufactured using staves which can be color matched with more precision. It also eliminates the grain direction change problem which creates a striped nose appearance on the stairs when viewed from the top of a staircase, and hence improves the aesthetic appeal of the entire staircase.

The advantages of having scotia 18 attached to the bottom of the front edge of stair tread 12 include a material savings in the manufacturing process. That is, the scotia attachment as designed can be manufactured from the same 4-4 wood raw material as the step surface 12. Significant cost savings are realized by using the same raw materials to manufacture the entire flat step surface. In contrast, if the bull nosing were attached by a tongue and groove joint on the front edge of the step surface, as known in the prior art, 5-4 wood raw material would be required; thereby, increasing material costs and set-up operation expenses.

The advantages of having scotia 18 attached to the bottom of the front edge of stair tread 12 also include increased strength and safety of the finished product. That is, there are no additional glue joints required on the flat step surface. The full strength of the wood board is preserved, and the integrity of the step surface is not compromised through additional machining. If the bull nosing were attached by a tongue and groove joint on the front edge of the step surface, as known in the prior art, or if the bull nosing were simply face-glued, the thin strip of wood required for the manufacture of the bull nosing would be at the very edge of the step. The increased machining in this process would require the removal of wood at the most stressed location on the step; thereby, weakening the structure at the most vulnerable location.

The advantages of having scotia 18 attached to the bottom of the front edge further include an increased aesthetic appeal. The entire flat step surface 12 is a continuous construction of wood staves of similar grain direction. Wood surfaces with a single grain direction take stains more consistently across the entire surface. Since a change in grain appearance produces a distracting visual element, this design is aesthetically appealing as it provides a continuous color appearance across the entire stair case.

Thus, the exemplary embodiment of the disclosure herein describes a unique design of a stair tread overlay to facilitate manufacturing efficiency, increase strength and safety, and provide maximum aesthetic appeal of the final product.

Although certain preferred embodiments of the present invention have been shown and described in detail, it should be understood that various changes and modifications may be made therein without departing from the scope of the appended claims.

I claim:

1. A stair tread overlay for a staircase, comprising:

a generally planar stair tread having an upper surface, a bottom surface, and an integrally formed rounded nosing extending from an end thereof; and a scotia element joined to said stair tread, said scotia element including a front contoured surface and a planar back side surface;

wherein a bottom surface of the nosing of said stair tread includes one of a tongue or groove and an upper surface of said scotia element includes the other of a tongue or groove;

wherein said tongue and groove of the nosing of said tread and said scotia element are secured together to form a joint to thereby connect said scotia element to said tread; and wherein said rounded nosing of said stair tread defines an upper portion of a bullnose arc and said scotia element includes a portion defining a lower portion of the bullnose arc, the upper portion of the bullnose arc on the stair tread and the lower portion of the bullnose arc on the scotia element forming a continuously curved bullnose.

2. The stair tread overlay according to claim 1, wherein said scotia element includes a coping moulding.

3. The stair tread overlay according to claim 1, wherein the bottom surface of the nosing of said stair tread includes the groove and the scotia element includes the tongue.

* * * * *